US008428298B2

(12) United States Patent
Ando et al.

(10) Patent No.: US 8,428,298 B2
(45) Date of Patent: Apr. 23, 2013

(54) DAMPER FOR SPEAKER AND SPEAKER USING THE DAMPER

(75) Inventors: Kimihiro Ando, Mie (JP); Kazuyoshi Umemura, Mie (JP)

(73) Assignee: Panasonic Corporation, Osaka (JP)

( * ) Notice: Subject to any disclaimer, the term of this patent is extended or adjusted under 35 U.S.C. 154(b) by 1307 days.

(21) Appl. No.: 12/162,021

(22) PCT Filed: Apr. 3, 2007

(86) PCT No.: PCT/JP2007/057447

§ 371 (c)(1),
(2), (4) Date: Jul. 24, 2008

(87) PCT Pub. No.: WO2007/114434

PCT Pub. Date: Oct. 11, 2007

(65) Prior Publication Data

US 2009/0028377 A1 Jan. 29, 2009

(30) Foreign Application Priority Data

Apr. 4, 2006 (JP) ..... 2006-102696

(51) Int. Cl.
*H04R 1/00* (2006.01)
*H04R 7/00* (2006.01)
*G10K 13/00* (2006.01)

(52) U.S. Cl.
USPC ..... 381/423; 181/171; 181/172; 381/398; 381/403; 381/404

(58) Field of Classification Search ..... 381/423, 381/398, 403, 404
See application file for complete search history.

(56) References Cited

U.S. PATENT DOCUMENTS

| | | | | |
|---|---|---|---|---|
| 5,847,333 | A * | 12/1998 | D'Hoogh | 181/171 |
| 6,031,925 | A * | 2/2000 | Shteyn | 381/401 |
| 7,929,724 | B2 * | 4/2011 | Funahashi | 381/398 |
| 7,974,434 | B2 * | 7/2011 | Funahashi | 381/398 |
| 8,005,253 | B2 * | 8/2011 | Funahashi | 381/403 |
| 8,041,068 | B2 * | 10/2011 | Funahashi | 381/398 |
| 8,085,970 | B2 * | 12/2011 | Funahashi | 381/404 |
| 8,094,862 | B2 * | 1/2012 | Funahashi | 381/398 |
| 8,116,510 | B2 * | 2/2012 | Umemura | 381/398 |

(Continued)

FOREIGN PATENT DOCUMENTS

| | | |
|---|---|---|
| JP | 26-009105 | 8/1951 |
| JP | 31-014506 | 9/1956 |

(Continued)

OTHER PUBLICATIONS

Full machine English translation of JP 2005-109851, Apr. 2005.

(Continued)

*Primary Examiner* — David Warren
*Assistant Examiner* — Christina Russell
(74) *Attorney, Agent, or Firm* — Wenderoth, Lind & Ponack, LLP.

(57) ABSTRACT

A speaker has high sound quality by reducing resonance of curved parts in a speaker damper without decreasing sound pressure and by providing high linearity characteristic. In a damper for a speaker formed by including at least two curved parts, an elastic member is provided at least on one side or on both sides of a peripheral part in a movable part of the damper or provided in the material.

17 Claims, 6 Drawing Sheets

U.S. PATENT DOCUMENTS

| | | | | |
|---|---|---|---|---|
| 8,295,538 | B2 * | 10/2012 | Harris et al. | 381/404 |
| 2003/0079936 | A1 * | 5/2003 | Kuze et al. | 181/171 |
| 2005/0078849 | A1 * | 4/2005 | Funahashi et al. | 381/412 |
| 2005/0254682 | A1 * | 11/2005 | Maekawa et al. | 381/404 |
| 2008/0317275 | A1 * | 12/2008 | Funahashi | 381/398 |
| 2009/0052724 | A1 * | 2/2009 | Umemura | 381/398 |
| 2009/0080685 | A1 * | 3/2009 | Funahashi | 381/398 |

FOREIGN PATENT DOCUMENTS

| | | | |
|---|---|---|---|
| JP | 42-007848 | | 4/1967 |
| JP | 50-18231 | | 2/1975 |
| JP | 56-049188 | | 11/1981 |
| JP | 62-193399 | | 8/1987 |
| JP | 2-133097 | | 11/1990 |
| JP | 3-247099 | | 11/1991 |
| JP | 11-510033 | | 8/1999 |
| JP | 2005-109851 | | 4/2005 |
| WO | WO 2007/034752 | * | 3/2007 |
| WO | WO 2007034752 A1 | * | 3/2007 |

OTHER PUBLICATIONS

International Search Report issued May 15, 2007 in the International (PCT) Application of which the present application is the U.S. National Stage.

* cited by examiner

FIG. 4 - PRIOR ART

FIG. 5A – PRIOR ART
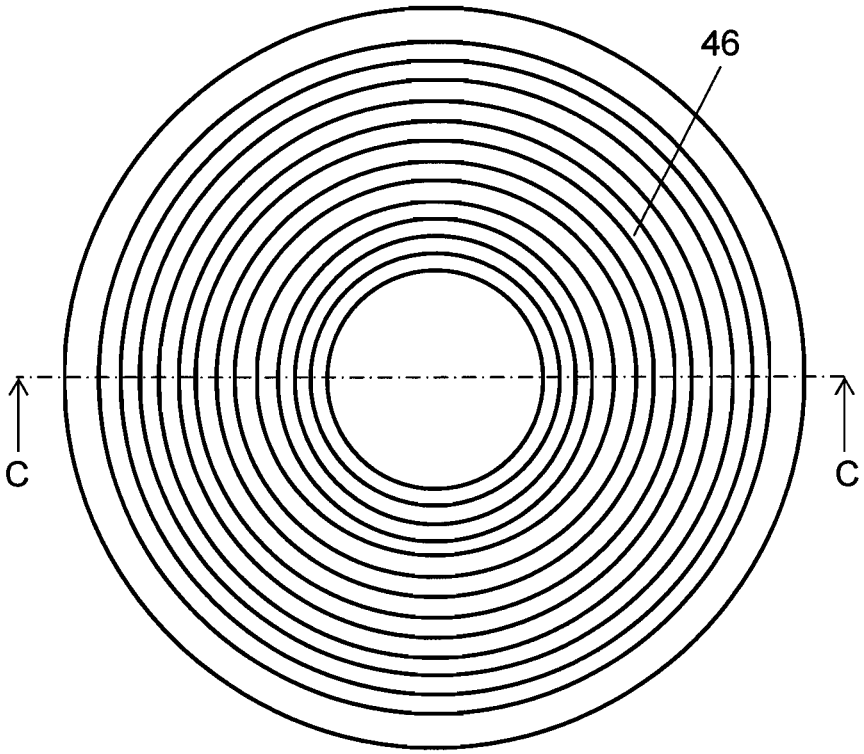
FIG. 5B – PRIOR ART
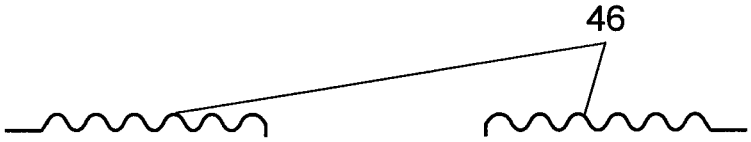

FIG. 6A - PRIOR ART
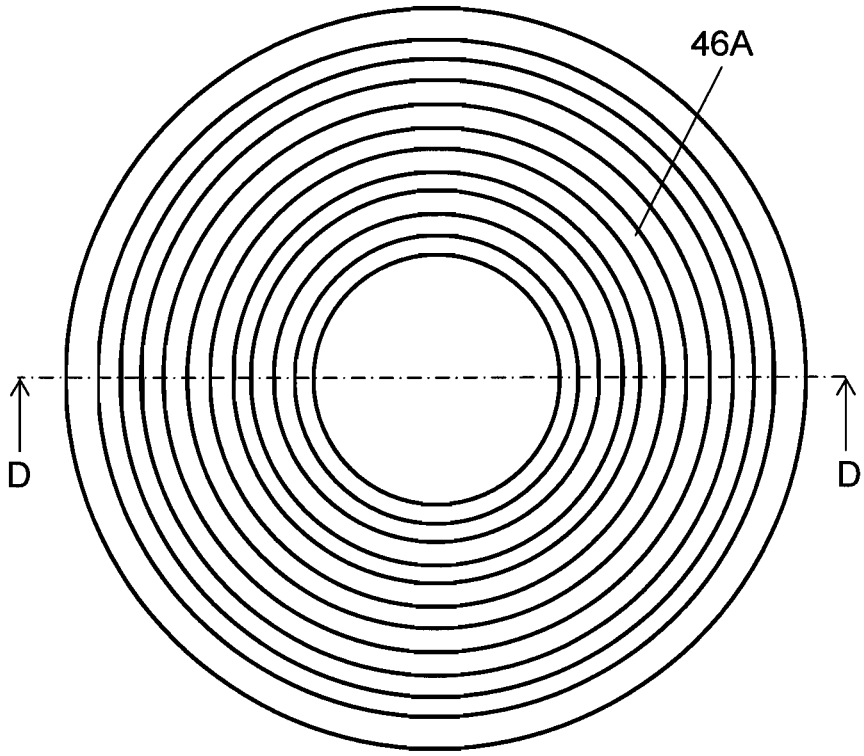
FIG. 6B – PRIOR ART
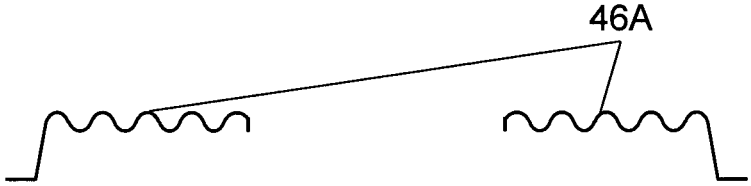

DAMPER FOR SPEAKER AND SPEAKER USING THE DAMPER

This application is a U.S. national phase application of PCT International Application PCT/JP2007/057447, filed Apr. 3, 2007.

TECHNICAL FIELD

The present invention relates to a damper for a speaker and a speaker using the same.

BACKGROUND ART

The technique related to a conventional damper for a speaker and a speaker using the damper will be described with reference to FIG. 4, FIGS. 5A and 5B, and FIGS. 6A and 6B.

FIG. 4 is a cross section of a conventional speaker. In FIG. 4, a magnetic circuit is constructed by plates 43 and 44 and magnet 42. When current according to a sound signal flows in voice coil 41 disposed in a magnetic gap, a force according to the current flowing in voice coil 41 and density of magnetic flux interlinked with voice coil 41 acts on voice coil 41. Since diaphragm 45 is coupled to voice coil 41, it moves integrally with voice coil 41. Diaphragm 45 and voice coil 41 are supported by edge 47 and damper 46, respectively. Edge 47 and damper 46 change their shapes and are movable in the vertical direction, thereby moving diaphragm 45 in the vertical direction and generating sound pressure.

In a general speaker, edge 47 has a large-curve shape which allows large amplitude. The stiffness of edge 47 itself is designed to be low. Since damper 46 supporting voice coil 41 needs a high center holding force so as not to be in contact with the magnetic circuit when voice coil 41 vibrates, damper 46 has a shape including a plurality of small curves. Usually, damper 46 is set to have stiffness higher than that of edge 47, and the stiffness of damper 46 is dominant in the whole speaker. One of the big factors exerting influence on distortion as a serious drawback of a speaker is nonlinearity caused by fluctuations in the stiffness. From the viewpoint of the distortion performance, it is important that stiffness is constant irrespective of fluctuations in diaphragm 45. Since the stiffness of damper 46 is dominant in that, in the entire speaker, the linearity in the vertical direction of damper 46 conspicuously exerts an influence on distortion of the speaker.

FIG. 5A is a plan view of damper 46 of the conventional speaker. FIG. 5B is a cross section taken along line C-C in FIG. 5A. As shown in FIG. 5B, for damper 46, wavy woven or nonwoven cloth in which a plurality of curved parts are formed in cross section and which is impregnated in a thermosetting resin is used.

FIG. 6A is a plan view of another conventional damper 46A. FIG. 6B is a cross section taken along line D-D of FIG. 6A.

As shown in FIG. 6B, damper 46A has a rise part from a face bonded to a frame and has a plurality of curved parts. Since there is the rise part, a large dimension of contact to the frame, of damper 46A can be realized. Since the distance of the damper from the part bonded to the frame to a part bonded to the voice coil can be made long, the amplitude in the vertical direction of the damper can be made large.

Known related prior art includes, for example, Unexamined Japanese Patent Publication No. H62-193399 and Tamon Saeki, "Encyclopedia of Speakers and Enclosures", Seibundo Shinkosha Inc., May 28, 1999, p. 62.

However, the techniques have the following drawbacks. To increase the vertical amplitude of the damper itself, the radius of the curved part has to be increased. When the radius of the curved part is increased, the stiffness is increased by the shape of the curve itself. In a damper having a small diameter, it is difficult to realize increase in the radius of the curved part. Curves may be partly formed large. In this case, symmetry in the vertical direction deteriorates and stress is concentrated on the enlarged curves. There is consequently the possibility that the damper is destroyed from fatigue caused by vertical vibrations.

There is also prior art disclosing a method of using, as a damper material, a supporting member obtained by stacking a rubber layer as an elastic member on woven or nonwoven fabric in order to solve the problems. However, the mass of the damper itself increases and, as a result, the mass of the vibration system becomes large. There is a problem that the sound pressure decreases.

SUMMARY OF THE INVENTION

To solve the problem, in a damper for a speaker of the present invention and a speaker using the damper formed by including at least two curved parts, an elastic member is provided on one side or on both sides of a peripheral part in a movable part of the damper or provided in the material. With this configuration, without increasing the mass of a vibration system, resonance of the damper can be reduced, and sound quality can be improved.

Specifically, in a damper for a speaker and a speaker using the damper of the present invention, an elastic member is provided on one side or on both sides of a peripheral portion in a movable part of the damper formed by including at least two curve parts or provided in a material. The elastic member is not provided in an inner peripheral portion other than the outer peripheral portion. With the configuration, resonance of the curve portion can be reduced. Since the center portion which is coupled to the voice coil is formed by the curved part, without increasing the mass of the vibration system, high sound pressure can be obtained, high linearity is obtained, and distortion can be reduced.

BRIEF DESCRIPTION OF DRAWINGS

FIG. 4 is a cross section of a conventional speaker;

FIG. 5A is a plan view of a conventional damper;

FIG. 5B is a cross section taken along line C-C of FIG. 5A;

FIG. 6A is a plan view of another conventional damper; and

FIG. 6B is a cross section taken along line D-D of FIG. 6A.

DETAILED DESCRIPTION OF THE PREFERRED EMBODIMENTS

The present invention will be described below with reference to a preferred embodiment. The description given above in connection with the related art will not be repeated.

Figure 1A:
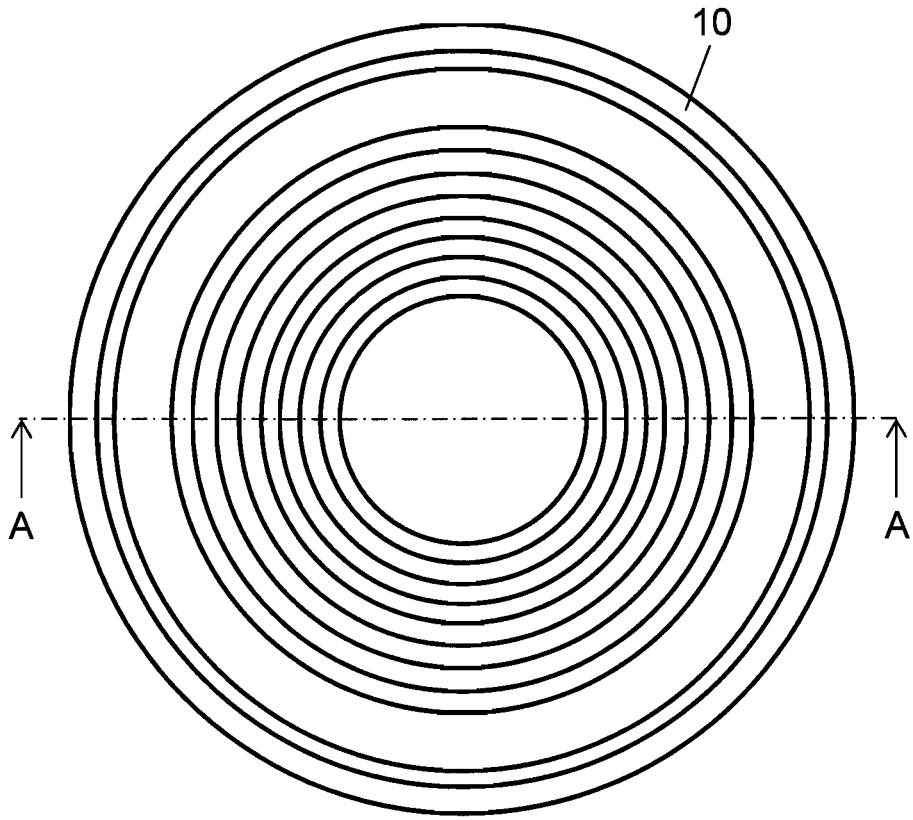
FIG. 1A is a plan view of a damper for a speaker in an embodiment of the present invention.
Figure 1B:
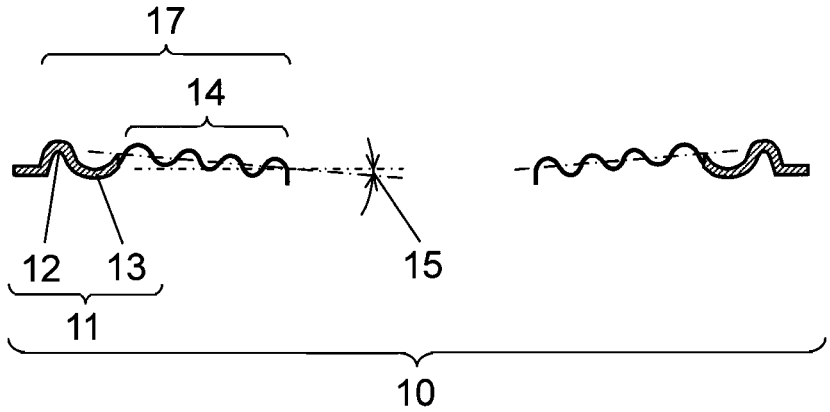
FIG. 1B is a cross section taken along line A-A of FIG. 1A.
Figure 1C:
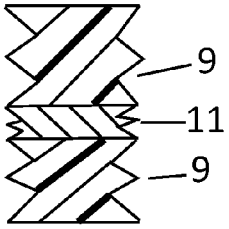
FIG. 1C schematically shows a cross section of a peripheral portion of the damper of FIGS. 1A and 1B with an elastic member on both sides (i.e., both faces) of the peripheral portion of the damper.
Figure 1D:
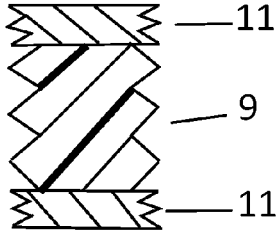
FIG. 1D schematically shows a cross section of a peripheral portion of the damper of FIGS. 1A and 1B with an elastic member provided in the material of the peripheral portion of the damper.

FIG. 1A is a plan view of damper 10 for a speaker in the embodiment of the present invention. FIG. 1B is a cross section taken along line A-A in damper 10. FIG. 1C schematically shows a cross section of a peripheral portion of the damper of FIGS. 1A and 1B with an elastic member on both sides (i.e., both faces) of the peripheral portion of the damper. FIG. 1D schematically shows a cross section of a peripheral portion of the damper of FIGS. 1A and 1B with an elastic member provided in the material of the peripheral portion of the damper.

Figure 2:
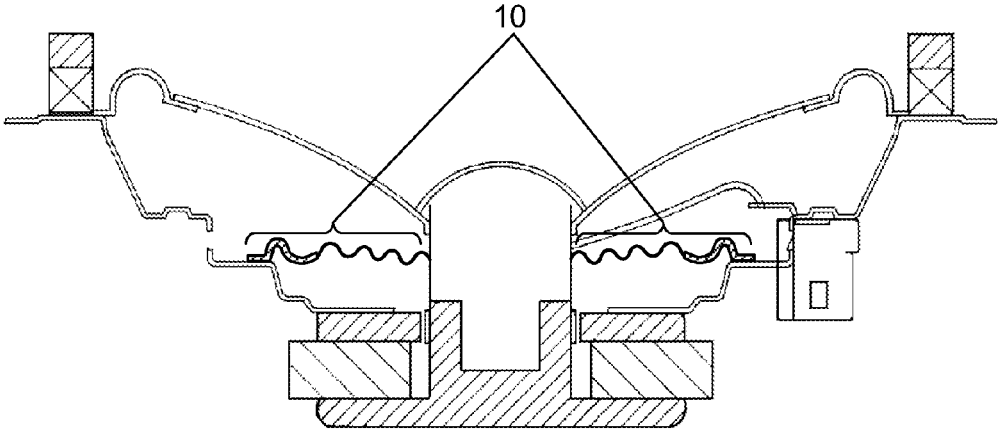
FIG. 2 is a cross section of a speaker using the damper for a speaker of the embodiment.

FIG. 2 is a cross section of a speaker using damper 10.

Figure 3A:
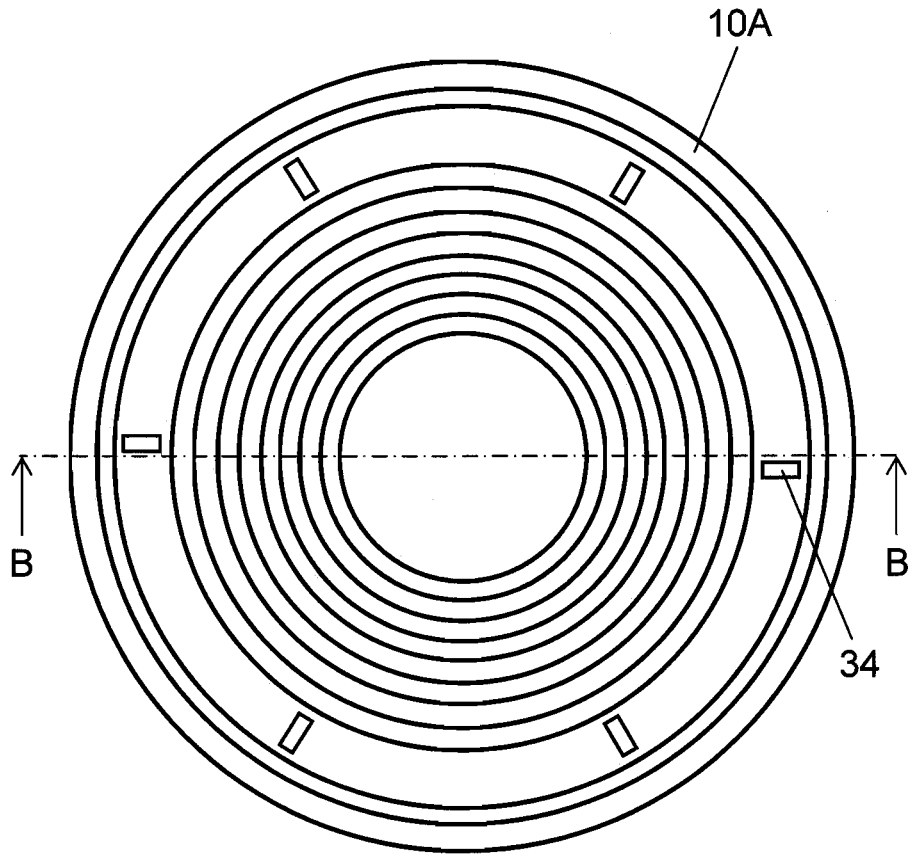
FIG. 3A is a plan view of a speaker damper having slits as a modification of the embodiment.
Figure 3B:
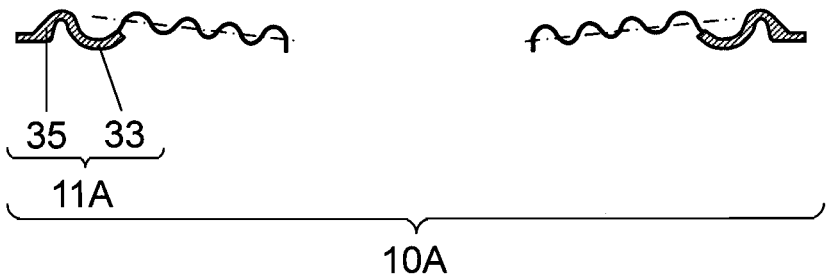
FIG. 3B is a cross section taken along line B-B of FIG. 3A.
Figure 3C:
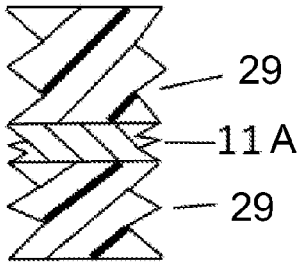
FIG. 3C schematically shows a cross section of a peripheral portion of the damper of FIGS. 3A and 3B with an elastic member on both sides (i.e., both faces) of the peripheral portion of the damper.
Figure 3D:
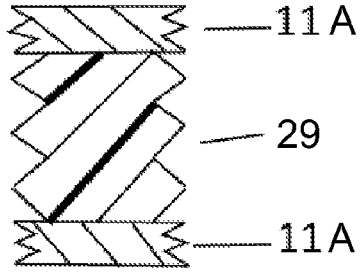
FIG. 3D schematically shows a cross section of a peripheral portion of the damper of FIGS. 3A and 3B with an elastic member provided in the material of the peripheral portion of the damper.
Figure 3D:
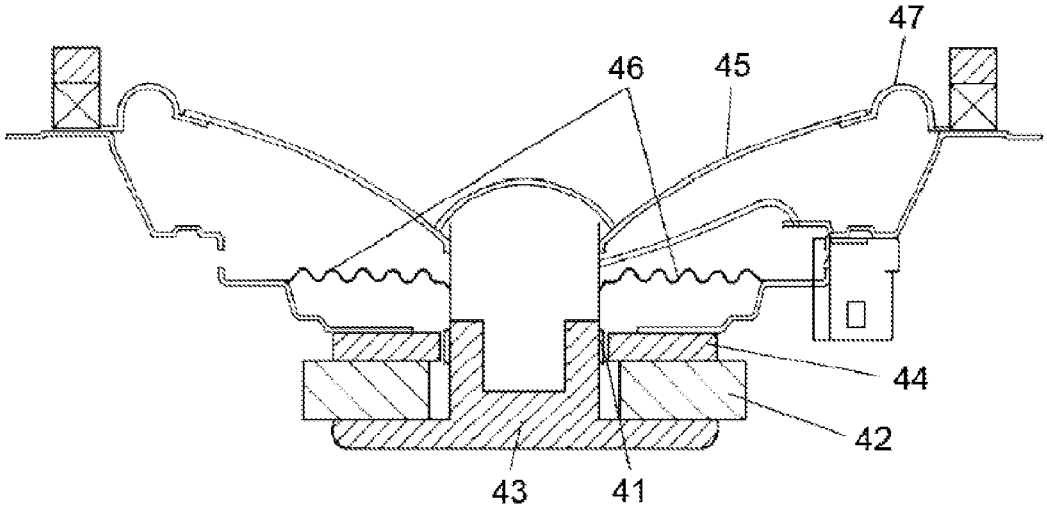

FIG. 3A is a plan view of damper 10A for a speaker, having slits as a modification of the embodiment. FIG. 3B is a cross section taken along line B-B in damper 10A. FIG. 3C schematically shows a cross section of a peripheral portion of the damper of FIGS. 3A and 3B with an elastic member on both sides (i.e., both faces) of the peripheral portion of the damper. FIG. 3D schematically shows a cross section of a peripheral portion of the damper of FIGS. 3A and 3B with an elastic member provided in the material of the peripheral portion of the damper.

As shown in FIGS. 1A and 1B, an elastic member 9 is provided on one side or both sides of peripheral portion 11 (see FIG. 1C) in movable part 17 of damper 10, formed by two or more curved parts 13 and 14 or provided in the material (see FIG. 1D), and an elastic member is not provided in an inner part other than peripheral portion 11. Rise part 12 is provided in peripheral portion 11 of damper 10. The radius of curved part 13 in peripheral portion 11 is 1.5 times as large as that of curved part 14 outside of peripheral portion 11. Thus, as shown in FIG. 1B, the curved part of the peripheral portion (i.e., outer peripheral section) 11 is greater in height than the curved parts outside of the peripheral portion (i.e., in the inner peripheral section). Further, a rubber member as an elastic member 9 is coupled, for example, on both sides of large curved part 13 in peripheral portion 11. One method of coupling the rubber as the elastic member 9 to a damper made by woven or nonwoven fabric is insert molding for integrally inserting a damper at the time of forming rubber. The rubber may be foamed rubber. In this case, the weight can be reduced. The rubber is coupled on the outer side of the intermediate point between the outermost radius and the inner radius of movable part 17 of damper 10.

Generally, peripheral portion 11 of damper 10 is fixed to the frame by an adhesive. In this case, a part from rise part 12 of damper 10 to a part bonded to the voice coil corresponds to movable part 17 which can move by vibrations of the voice coil.

A regular electrodynamic speaker needs large amplitude vibration in a low sound range, so that damper 10 is requested to have large amplitude vibration and high linearity. In intermediate and high sound ranges, the required amplitude is small but, to generate high sound pressure, it is requested to suppress the mass of a vibration part.

In damper 10 of FIGS. 1A and 1B, at the time of large amplitude vibration in the low sound range, since the radius of curved part 13 in peripheral part 11 is large, by deformation of curved part 13, large amplitude vibration can be obtained. Although there may be stress fatigue in curved part 13 in peripheral part 11 due to large amplitude vibration, since the rubber as the elastic member 9 is disposed on, for example, both sides of curved part 13, excessive vibration or resonance can be reduced. In addition, damper resonance which tends to occur in curved part 13 having a large radius exerts an influence on disturbance of the characteristics of the intermediate sound range. By reducing internal loss resonance of the rubber as the elastic member 9, the disturbance of the characteristics can be also reduced.

Curved part 13 in peripheral portion 11, having a large radius enables large amplitude vibration to be generated. Curved part 14 on the outside of peripheral portion 11 tends to have asymmetry in the vertical direction when curved part 13 is largely deformed and vibrates. Therefore, by arranging curves so that the centers of the curves draw a locus having an almost cone shape at angle 15 of curved part 14 from the outer periphery toward the inner periphery, the vertical symmetry of curved part 14 outside of peripheral portion 11 can be changed. Consequently, in the case where curved part 13 in peripheral portion 11 is a downward curve as shown in FIG. 1B, by forming curved part 14 on the outside of peripheral portion 11 in an inverted cone shape, the vertical symmetry of entire damper 10 can be improved.

As the operations of damper 10 in the intermediate/high sound range, curved part 13 in peripheral portion 11 having small required amplitude vibration and large radius hardly moves, and only curved part 14 on the outside of peripheral portion 11 having the small radius moves. Consequently, the substantial vibration system mass in the mass of damper 10 is the mass of only curved part 14 other than peripheral portion 11, to which the elastic member such as rubber is not attached. The vibration system mass is light, and high sound pressure can be obtained.

FIG. 2 shows the configuration of a speaker using damper 10 of the embodiment. Since the speaker is similar to the conventional speaker described in the related art except for damper 10, the description will not be repeated.

FIG. 3A is a plan view of a damper for a speaker, having slits as a modification of the embodiment. FIG. 3B is a cross section taken along line B-B of the damper. FIG. 3C schematically shows a cross section of a peripheral portion of the damper of FIGS. 3A and 3B with an elastic member on both sides of the peripheral portion of the damper. FIG. 3D schematically shows a cross section of a peripheral portion of the damper of FIGS. 3A and 3B with an elastic member provided in the material of the peripheral portion of the damper.

In damper 10A for a speaker shown in FIGS. 3A and 3B, slits 34 are partly provided in curved part 33 having a large radius in peripheral portion 11A of damper 10A. Curved part 33 itself having a large radius tends to become hard depending on the material of damper 10A and the aperture of damper 10A, and there is the case that stiffness of curved part 33 becomes asymmetrical in the vertical direction of amplitude. By partly providing slits 34 in curved part 33 having a large radius as in damper 10A, stiffness of curved part 33 itself having a large radius can be adjusted, asymmetry of stiffness in the vertical direction of amplitude of damper 10A can be easily adjusted, and distortion in the speaker can be reduced. It is expected that, in the case of providing slits 34, the dust proof function in the magnetic gap in damper 10A decreases. However, in the embodiment, by forming notches only in parts made of woven or nonwoven cloth and forming slits 34 simultaneously with molding of an elastic member 29 made of rubber, slits 34 can be closed with the rubber and the magnetic gap can be protected from dust.

Generally, in a damper having a rise part, in the case where the damper largely vibrates in the vertical direction, the strength of the rise part becomes insufficient, and the rise part is partly bent. This may cause deterioration in sound quality and decrease in reliability. However, in rise part 35 shown in FIG. 3B, by making a thickness of an elastic member coupled to peripheral portion 11A of damper 10A thicker than a thickness of curved part 33, strength of rise part 35 increases. Even when damper vibrates largely, the shape of rise part 35 can be maintained, and sound quality and reliability is also excellent.

The damper for a speaker and the speaker using the damper of the present invention can be applied as a damper and a speaker requested to realize high sound quality by decreasing resonance of the damper including at least two curved parts and by providing high linearity.

The invention claimed is:

1. A damper for a speaker, comprising:

a damper member having a plurality of curved parts, said damper member having an outer periphery, an inner periphery, an upper face and a lower face;

wherein said damper member includes an inner peripheral section, and an outer peripheral section that is located closer than said inner peripheral section to said outer periphery, such that said inner peripheral section is located radially inward of said outer peripheral section;

wherein an elastic member is provided within said damper member in said outer peripheral section thereof or on at least one of the upper face and the lower face of said damper member in said outer peripheral section thereof; and wherein the elastic member is provided to the damper member only in the outer peripheral section of the damper member.

2. The damper for a speaker, according to claim 1, wherein the elastic member is made of rubber or foamed rubber.

3. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 2, the outer peripheral section of the damper member being coupled to the frame and the inner peripheral section of the damper member being coupled to the voice coil to support the voice coil.

4. The damper for a speaker, according to claim 1, wherein the plurality of curved parts includes a curved part in the outer peripheral section and a curved part in the inner peripheral section, and a radius of the curved part in the outer peripheral section is 1.5 times as large as a radius of the curved part in the inner peripheral section.

5. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 4, the outer peripheral section of the damper member being coupled to the frame and the inner peripheral section of the damper member being coupled to the voice coil to support the voice coil.

6. The damper for a speaker, according to claim 1, wherein at least one slit is formed in the outer peripheral section of the damper member.

7. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 6, the outer peripheral section of the damper member being coupled to the frame and the inner peripheral section of the damper member being coupled to the voice coil to support the voice coil.

8. The damper for a speaker, according to claim 1, wherein the plurality of curved parts includes plural curved parts in the inner peripheral section disposed so that centers of said plural curved parts draw a locus of a cone shape.

9. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 8, the outer peripheral section of the damper member being coupled to the frame and the inner peripheral section of the damper member being coupled to the voice coil to support the voice coil.

10. The damper for a speaker, according to claim 1, wherein said elastic member is provided to said damper member in said outer peripheral section thereof and not in said inner peripheral section thereof, and said outer peripheral section of said damper member with said elastic member is thicker than said inner peripheral section of said damper member without said elastic member.

11. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 10, the outer peripheral section of the damper member being coupled to the frame and the inner peripheral section of the damper member being coupled to the voice coil to support the voice coil.

12. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 1, the outer peripheral section of the damper member being coupled to the frame and the inner peripheral section of the damper member being coupled to the voice coil to support the voice coil.

13. A damper for a speaker, comprising:

a damper member having a plurality of curved parts, said damper member having an outer periphery, an inner periphery, an upper face and a lower face;

wherein said damper member includes an inner peripheral section, and an outer peripheral section that is located closer than said inner peripheral section to said outer periphery, such that said inner peripheral section is located radially inward of said outer peripheral section;

wherein an elastic member is provided to said damper member in said outer peripheral section, said inner peripheral section having no elastic member;

wherein said plurality of curved parts includes an outer curved part in the outer peripheral section and plural inner curved parts in the inner peripheral section; and wherein said outer curved part is larger in height than all of the inner curved parts.

14. The damper for a speaker, according to claim 13, wherein the elastic member is provided within said damper member in said outer peripheral section thereof or on at least one of the upper face and the lower face of said damper member in said outer peripheral section thereof.

15. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 14, the outer peripheral section of the damper member being coupled to the frame and the inner peripheral section of the damper member being coupled to the voice coil to support the voice coil.

16. The damper for a speaker, according to claim 13, wherein the elastic member is provided to the damper member only in the outer peripheral section of the damper member.

17. A speaker comprising:

a magnetic circuit having at least a magnetic gap;

a frame attached to the magnetic circuit;

a diaphragm having an outer periphery that is directly or indirectly coupled to the frame and an inner periphery that is coupled to a voice coil which is fit in the magnetic gap; and a damper for a speaker, according to claim 13, the outer peripheral section of the damper member being coupled to the frame and the inner peripheral section of the damper member being coupled to the voice coil to support the voice coil.

* * * * *